US007698971B1

(12) United States Patent
Rosa

(10) Patent No.: US 7,698,971 B1
(45) Date of Patent: Apr. 20, 2010

(54) FOOT PEG ENGAGING TOOL

(76) Inventor: Ronald Rosa, 4029 Kristina Lynn Ave., North Las Vegas, NV (US) 89081

( * ) Notice: Subject to any disclaimer, the term of this patent is extended or adjusted under 35 U.S.C. 154(b) by 0 days.

(21) Appl. No.: 12/117,030

(22) Filed: May 8, 2008

(51) Int. Cl.
*B25B 13/50* (2006.01)

(52) U.S. Cl. ..... 81/176.1

(58) Field of Classification Search ..... 81/176.1, 81/176.15, 176.2; D8/27
See application file for complete search history.

(56) References Cited

U.S. PATENT DOCUMENTS

| | | | | | |
|---|---|---|---|---|---|
| 39,876 | A | * | 9/1863 | Bolton | 81/176.15 |
| 58,313 | A | * | 9/1866 | Soumeillian | 81/176.1 |
| 922,258 | A | | 5/1909 | Caven | |
| 2,518,088 | A | | 8/1950 | Spielman | |
| 2,536,172 | A | * | 1/1951 | Halperin | 81/176.2 |
| 4,374,453 | A | * | 2/1983 | Rodriguez | 81/176.15 |
| 4,532,834 | A | | 8/1985 | Hartman | |
| 4,964,664 | A | * | 10/1990 | Crittenden | 294/15 |
| D320,725 | S | | 10/1991 | Rubesh | |
| 5,524,511 | A | | 6/1996 | Taka's | |
| 2002/0144572 | A1 | | 10/2002 | Chaves | |
| 2005/0022631 | A1 | * | 2/2005 | Brazil | 81/119 |

* cited by examiner

*Primary Examiner*—Hadi Shakeri

(57) ABSTRACT

A foot peg engaging tool includes an elongated member that has a first end and a second end. A saddle has a first side, a second side, a first end edge and a second end edge. The saddle has a semicircular shape and the first side is convexly arcuate from the first end edge to the second end edge. The first end of the elongated member is attached to the second side of the saddle. A rod is attached to the first side of the saddle. The rod is extendable into a foot peg to releasably couple the elongated member to the foot peg.

2 Claims, 3 Drawing Sheets

FOOT PEG ENGAGING TOOL

BACKGROUND OF THE INVENTION

Field of the Invention

The present invention relates to bicycle tool devices and more particularly pertains to a new bicycle tool device for assisting a person in removing or attaching a foot peg to a bicycle.

SUMMARY OF THE INVENTION

The present invention meets the needs presented above by generally comprising an elongated member that has a first end and a second end. A saddle has a first side, a second side, a first end edge and a second end edge. The saddle has a semicircular shape and the first side is convexly arcuate from the first end edge to the second end edge. The first end of the elongated member is attached to the second side of the saddle. A rod is attached to the first side of the saddle. The rod is extendable into a foot peg to releasably couple the elongated member to the foot peg.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
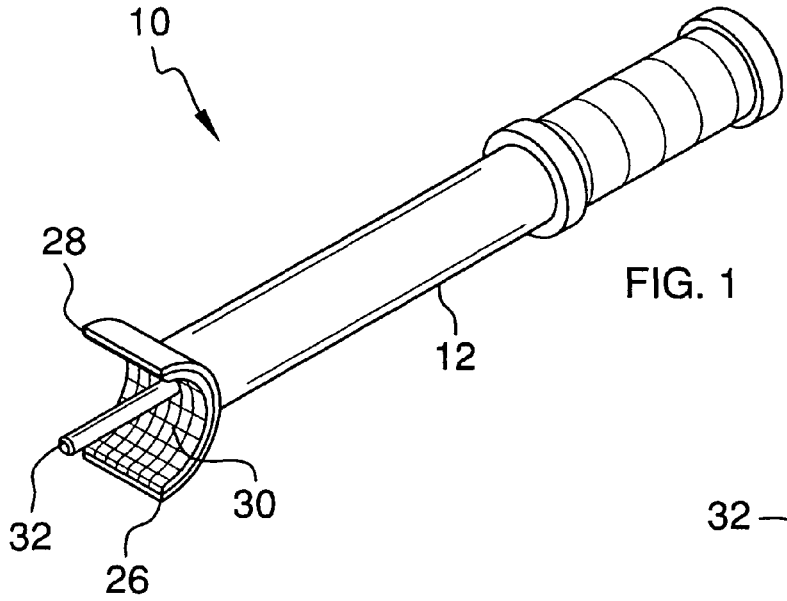
FIG. 1 is a perspective view of a foot peg engaging tool according to the present invention.
Figure 3:
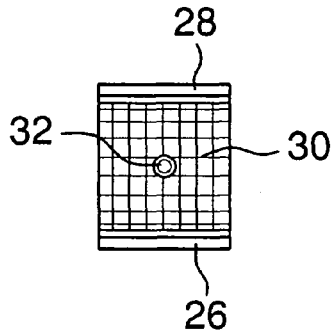
FIG. 3 is a front view of the present invention.
Figure 2:
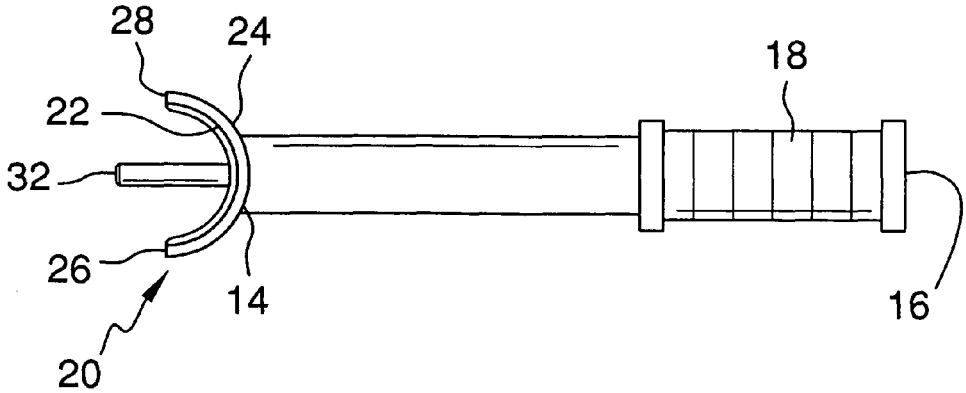
FIG. 2 is a side view of the present invention.
Figure 4:
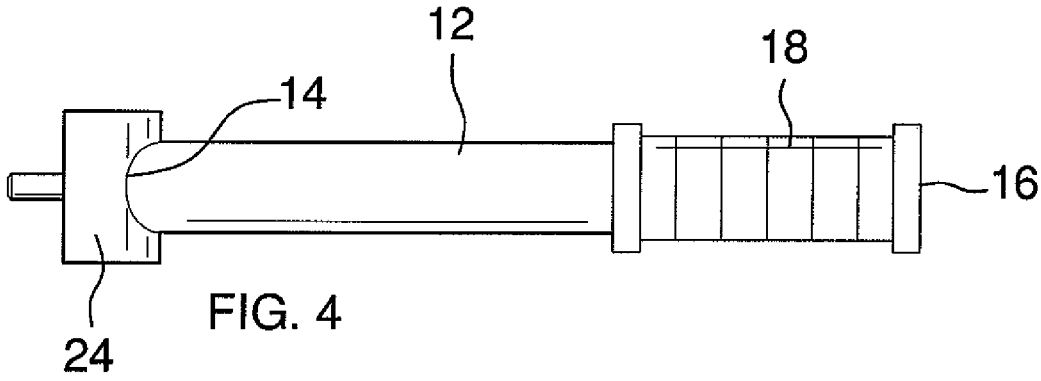
FIG. 4 is a top view of the present invention.
Figure 5:
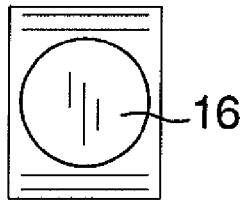
FIG. 5 is a rear view of the present invention.
Figure 6:
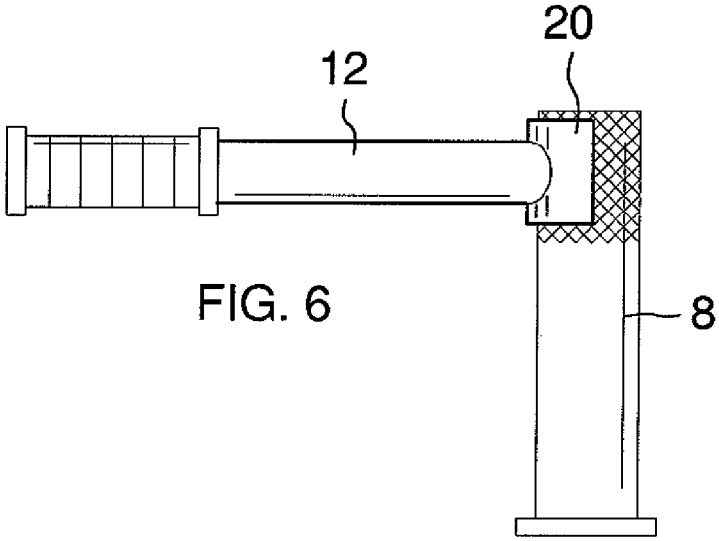
FIG. 6 is a top in-use view of the present invention.

With reference now to the drawings, and in particular to FIGS. 1 through 7 thereof, a new bicycle tool device embodying the principles and concepts of the present invention and generally designated by the reference numeral 10 will be described.

As best illustrated in FIGS. 1 through 7, the foot peg 8 engaging tool 10 generally comprises an elongated member 12 that has a first end 14 and a second end 16. A portion of the elongated member adjacent to the second end 16 comprises a grip 18 and may include an elastomeric covering.

A saddle 20 has a first side 22, a second side 24, a first end edge 26 and a second end edge 28. The saddle 20 has a semicircular shape and the first side 22 is concavely arcuate from the first end edge 26 to the second end edge 28. This shape allows the saddle 20 to conform to the tubular shape of the foot peg 8. The first end 14 of the elongated member 12 is attached to the second side 24 of the saddle 20 and is equally spaced from the first 26 and second 28 end edges. The saddle 20 has a diameter equal to about 1½ inches measured from the first end edge 26 to the second end edge 28. An elastomeric coating 30 is positioned on and covers the first side 22 of the saddle 20. The coating 30 prevents damage to the foot peg 8 provides friction between the foot peg 8 and the saddle 20.

A rod 32 is attached to the first side 22 of the saddle 20. The rod 32 is extendable into the foot peg 8 to releasably couple the elongated member 12 to the foot peg 8. The rod 32 has a longitudinal axis is aligned with a longitudinal axis if the elongated member 12. The rod 32 has a length between 1½ inches and 2 inches.

Figure 7:
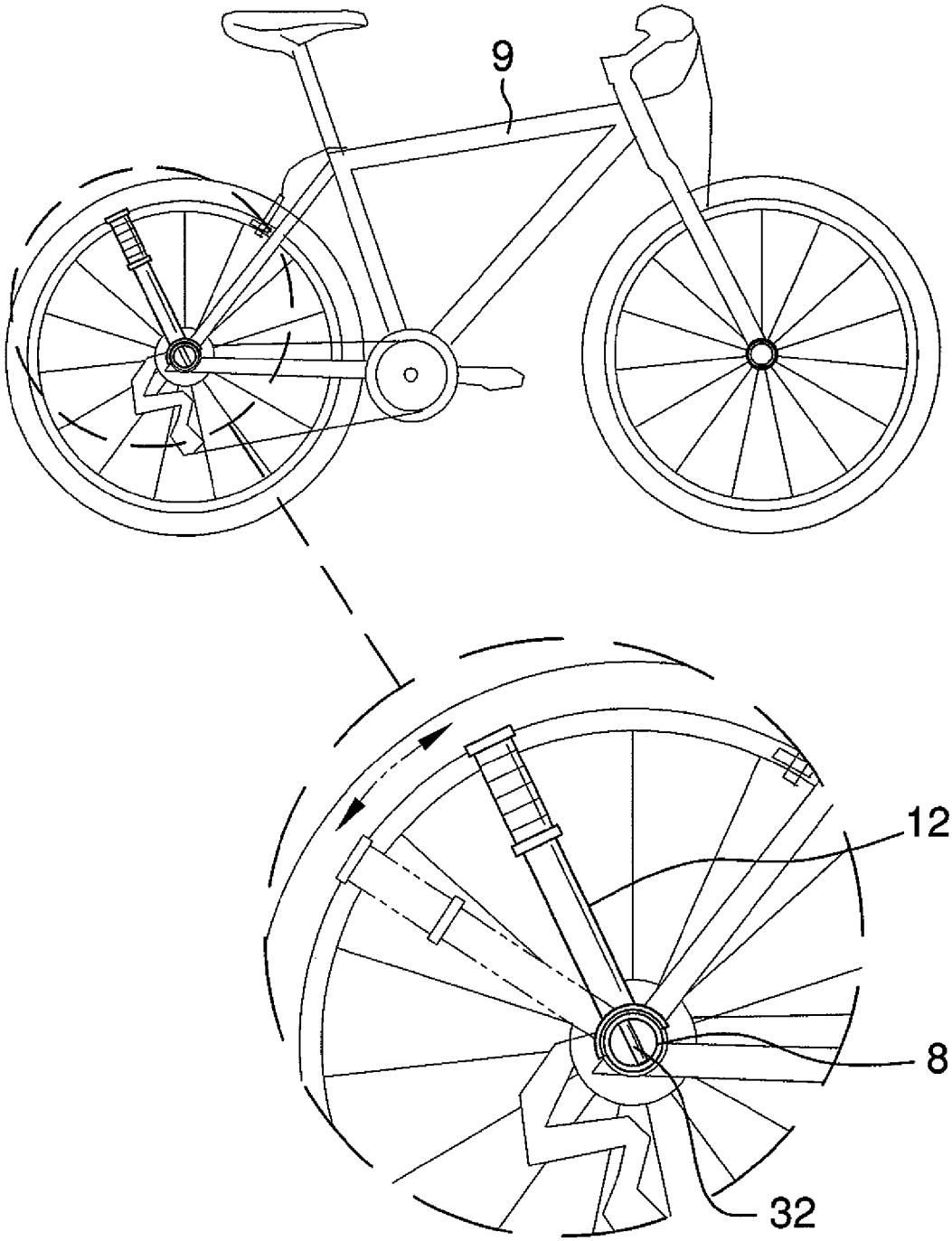
FIG. 7 is a side in-use view of the present invention.

In use, the rod 32 is extendable into the foot peg 8 as is shown in FIG. 7 so that the elongated member 12 may be used to rotate the foot peg 8 with respect to a bicycle 9. The foot peg is used for standing on while riding the bicycle 9 for doing tricks and the like. The tool 10 allows easy removal, attachment or replacement of the foot peg 8 to the bicycle 9.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method to mount or remove a foot peg from a bicycle, said method comprising the steps of:

providing a foot peg engaging tool comprising an elongated member having a first end and a second end, a portion of said elongated member adjacent to said second end comprising a grip; a saddle having a first side, a second side, a first end edge and a second end edge, said first side being concavely arcuate from said first end edge to said second end edge and forming a semicircular shape when viewed lateral to said first side and perpendicular to a longitudinal axis of said elongated member, said first end of said elongated member being attached to said second side of said saddle and being equally spaced from said first and second end edges; and a rod being attached to said first side of said saddle, said rod being extendable into the foot peg to releasably couple said elongated member to the foot peg, said rod having a longitudinal axis being aligned with a longitudinal axis if said elongated member;

engaging said rod into a foot peg; and using said elongated member to rotate the foot peg to mount or remove the foot peg from a bicycle.

2. The method according to claim 1, wherein the step of providing a foot peg engaging tool further comprises an elastomeric coating being positioned on and covering said first side of said saddle.

* * * * *